US007789463B2

(12) United States Patent
Gang

(10) Patent No.: US 7,789,463 B2
(45) Date of Patent: Sep. 7, 2010

(54) CHAIR WHICH IS USED IN WAIST ENHANCEMENT

(76) Inventor: Sung Gil Gang, 19 Seoseongno 1-Ga, Jung-Gu, 602 Family Town, Daegu (KR) 700-261

( * ) Notice: Subject to any disclaimer, the term of this patent is extended or adjusted under 35 U.S.C. 154(b) by 0 days.

(21) Appl. No.: 12/282,846

(22) PCT Filed: Mar. 15, 2007

(86) PCT No.: PCT/KR2007/001280

§ 371 (c)(1),
(2), (4) Date: Sep. 12, 2008

(87) PCT Pub. No.: WO2007/111428

PCT Pub. Date: Oct. 4, 2007

(65) Prior Publication Data

US 2009/0058156 A1 Mar. 5, 2009

(51) Int. Cl.
*A47C 1/00* (2006.01)

(52) U.S. Cl. ..... 297/314; 297/183.9

(58) Field of Classification Search ..... 297/314, 297/183.9

See application file for complete search history.

(56) References Cited

U.S. PATENT DOCUMENTS

| | | | | | |
|---|---|---|---|---|---|
| 30,706 | A | * | 11/1860 | Vleck | 297/314 X |
| 2,719,571 | A | * | 10/1955 | Taylor | 297/314 X |
| 3,191,594 | A | * | 6/1965 | Bagnell | 601/5 |
| 3,824,991 | A | * | 7/1974 | Whitaker | 601/5 |
| 4,607,882 | A | * | 8/1986 | Opsvik | 297/195.11 |
| 4,703,975 | A | * | 11/1987 | Roberts et al. | 297/183.9 X |
| 4,974,904 | A | * | 12/1990 | Phillips et al. | 297/258.1 |
| 5,113,851 | A | * | 5/1992 | Gamba | 601/84 |
| D355,985 | S | * | 3/1995 | Karten et al. | D6/374 |
| 5,590,930 | A | * | 1/1997 | Glockl | 297/313 |
| 5,695,245 | A | * | 12/1997 | Carlson et al. | 297/314 X |
| 5,728,049 | A | * | 3/1998 | Alberts | 297/314 X |
| 5,755,650 | A | * | 5/1998 | Urso | 297/183.9 |
| 5,769,492 | A | | 6/1998 | Jensen | |
| 5,967,610 | A | | 10/1999 | Lin | |

(Continued)

FOREIGN PATENT DOCUMENTS

| | | |
|---|---|---|
| JP | 2002-119362 | 4/2002 |

(Continued)

*Primary Examiner*—Rodney B White
(74) *Attorney, Agent, or Firm*—IPLA P.A.; James E. Bame

(57) ABSTRACT

A chair for enhancing a waist strength is disclosed, which can be easily used by anybody for thereby exercising waist, pelvis and belly muscles. The chair for a waist exercise comprises a seat which has a circular plate for stably supporting a user's hips, and a receptacle which is vertically extended in a downward direction from a lower side of the circular plate; a cylindrical connection unit which has an upper end inserted into the receptacle of the lower side of the seat and a certain absorbing force with respect to a pressure when the vertical weight of the seat is applied, with the length of the same being adjustable for thereby adjusting the height of the seat; and a support unit which has an upper side engaged at the lower side of the connection unit and is provided with a plurality of legs which are extended in a perpendicular direction.

3 Claims, 5 Drawing Sheets

PRIOR ART

U.S. PATENT DOCUMENTS

| | | | | |
|---|---|---|---|---|
| 6,059,363 | A | 5/2000 | Roslund, Jr. et al. | |
| D439,429 | S * | 3/2001 | Higgs et al. | D6/368 |
| 6,481,795 | B1 * | 11/2002 | Pettibon | 297/314 |
| 6,685,268 | B2 * | 2/2004 | Meyer | 297/314 X |
| 6,709,052 | B2 * | 3/2004 | Jalkanen | 297/202 |
| 7,044,547 | B2 * | 5/2006 | Sorrenti | 297/452.25 X |
| 7,090,303 | B2 * | 8/2006 | Kropa | 297/312 X |
| 7,100,983 | B1 * | 9/2006 | Gant | 297/314 |
| D550,002 | S * | 9/2007 | Genord et al. | D6/502 |
| 7,537,553 | B2 * | 5/2009 | Mongelluzzo et al. | 482/130 |
| 2002/0043846 | A1 * | 4/2002 | Brauning | 297/314 |
| 2004/0070238 | A1 * | 4/2004 | Moser et al. | 297/183.9 |
| 2005/0173952 | A1 * | 8/2005 | Van Der Laan | 297/314 X |
| 2009/0212605 | A1 * | 8/2009 | Buckner | 297/183.9 |

FOREIGN PATENT DOCUMENTS

| | | |
|---|---|---|
| KR | 20-0250516 | 10/2001 |
| KR | 20-0286984 | 8/2002 |

* cited by examiner

CHAIR WHICH IS USED IN WAIST ENHANCEMENT

TECHNICAL FIELD

The present invention relates to a chair.

BACKGROUND ART

The present invention relates to a chair, and in particular to a chair for enhancing a waist strength, which can be easily used by anybody for thereby exercising waist, pelvis and belly muscles.

Generally, a chair is designed so that a user can easily sit. The chair may be classified into many types based on their types, uses, structures and materials as an industrial society advances.

First, in the types of chairs, they may be classified into a stool, a chair, an arm-resting chair, a long chair, a lying down chair, a locking chair, etc.

Here, various cultures come into and are developed, people, who are used to just sit and enjoy their lives, increase more. The people, who are not used to sit on the chair, spend at least hours on the chair.

FIG. 1 is a perspective view illustrating a conventional chair. The conventional chair comprises a backrest 10, a seat 20 connected with the backrest 10, a cylindrical connection unit 40 which is installed at a rear center portion of the seat 20 for adjusting the height of the seat 20 depending on an operation of an up and down adjusting lever 30, and legs 50 which support the connection unit 40.

However, in the above conventional chair, when a user works for a long time, sitting on a chair for a long time. Since the chair does not move forward, backward and up and down directions, the user may gain weight in his waist and belly.

So, the user may gain weight in his belly, so that waist and belly muscles may be weakened for thereby causing a disk disease or a waist disease.

DISCLOSURE OF INVENTION

Technical Problem

Accordingly, it is an object of the present invention to provide a chair which overcomes the problems encountered in the conventional art and improves the problems of the utility model number 20-2006-0007106 "Chair for waist exercise" (filed on Mar. 16, 2006) filed by the same applicant as the present invention, in which it is possible to easily enhance waist, pelvic and belly muscle strengths.

ADVANTAGEOUS EFFECTS

As described above, the present invention is able to enhance a user's health by preventing a pain and fat gaining problem in a user's waist and belly in such a manner that a user can easily exercise a waist, belly and pelvic portion even during a resting time.

In addition, since a circular plate is provided with a pressurizing portion and protrusions, a blood circulation and strength enhancement are possible with the helps of the above pressurizing portion and protrusions.

Figure 1:
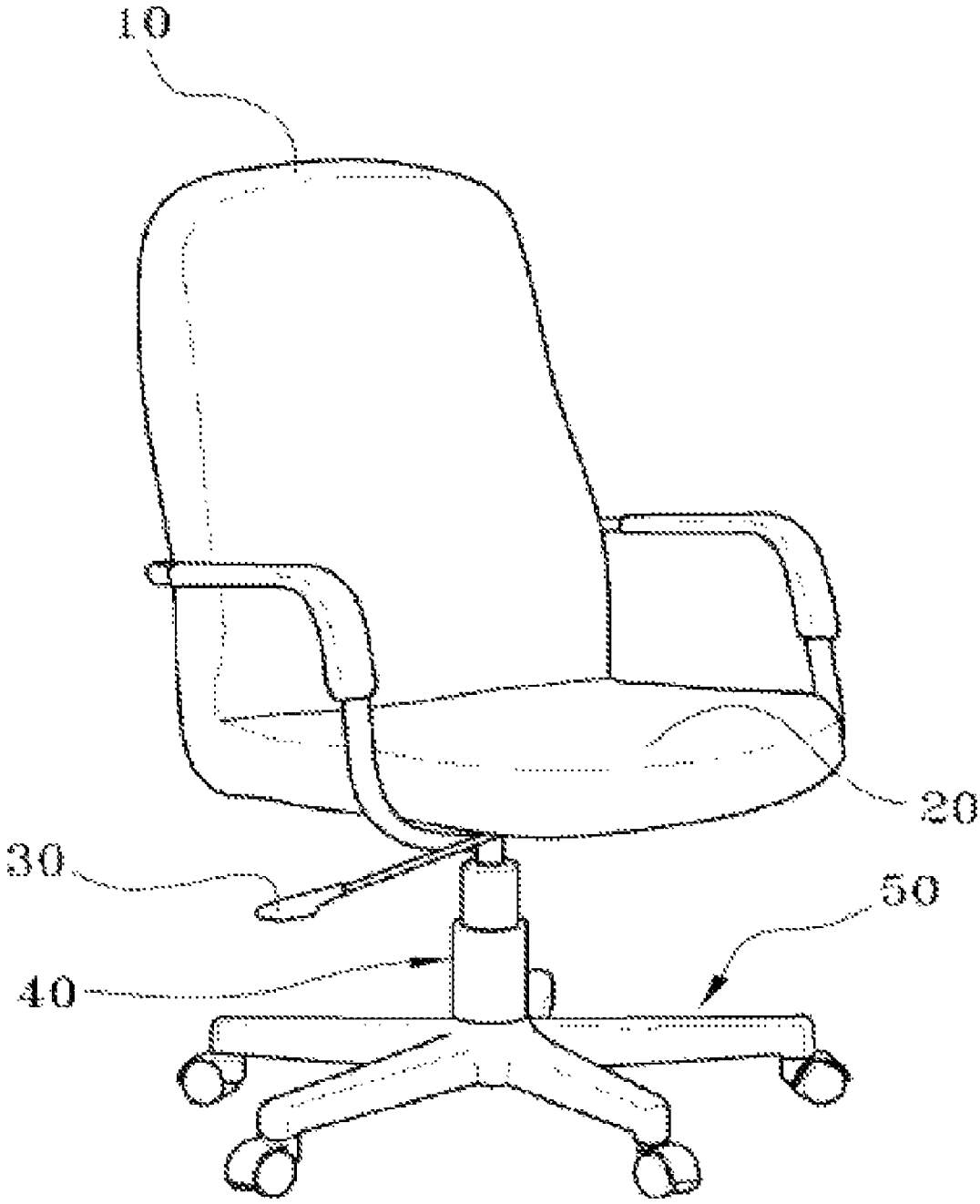
FIG. 1 PRIOR ART
FIG. 1 is a perspective view illustrating a conventional chair.

100: seat
110: circular plate
120: receptacle
125: spring
130, 140: handle
160: pressurizing portion
170: protrusion
200: up and down adjusting lever
300: connection unit
400: support unit

BEST MODE FOR CARRYING OUT THE INVENTION

To achieve the above objects, there is provided a chair for a waist exercise which comprises a seat which has a circular plate for stably supporting a user's hips, and a receptacle which is vertically extended in a downward direction from a lower side of the circular plate; a cylindrical connection unit which has an upper end inserted into the receptacle of the lower side of the seat and a certain absorbing force with respect to a pressure when the vertical weight of the seat is applied, with the length of the same being adjustable for thereby adjusting the height of the seat; and a support unit which has an upper side engaged at the lower side of the connection unit and is provided with a plurality of legs which are extended in a perpendicular direction.

The circular plate includes handles are concaved in a certain shape for supporting a user's body as the user holds the same in the course of a waist and pelvic rotation and are installed at both sides, and a plurality of pressurizing portions are provided between the handles for pressurizing the user's hips when he sits for thereby enhancing a blood circulation, and protrusions are provided on the portions in which the user's scrotum is positioned.

The receptacle and the upper side of the connection unit are connected with a spring which has a certain elastic recovery force.

The spring is formed with an upper side of the same being narrow, with a lower side of the same being wider.

The preferred embodiments of the present invention will be described with reference to the accompanying drawings.

Figure 2:
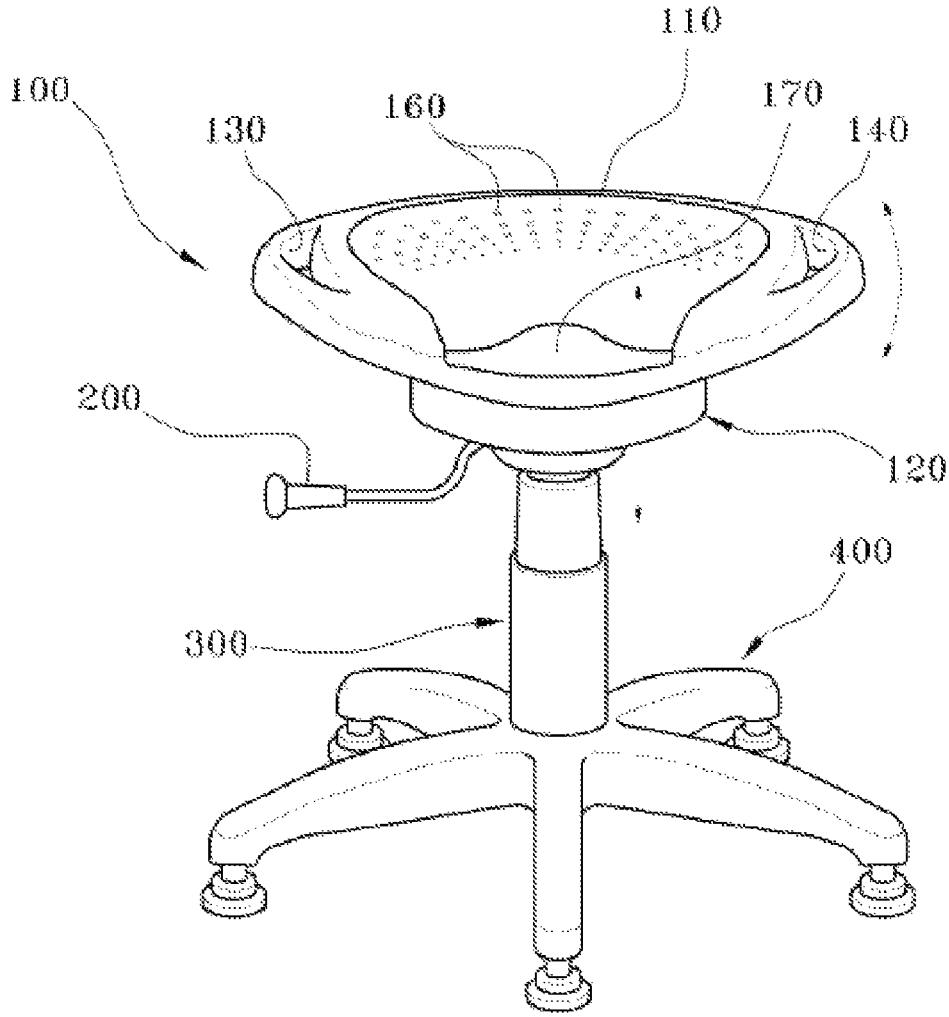
FIG. 2 is a perspective view illustrating a chair according to an embodiment of the present invention.
Figure 3:
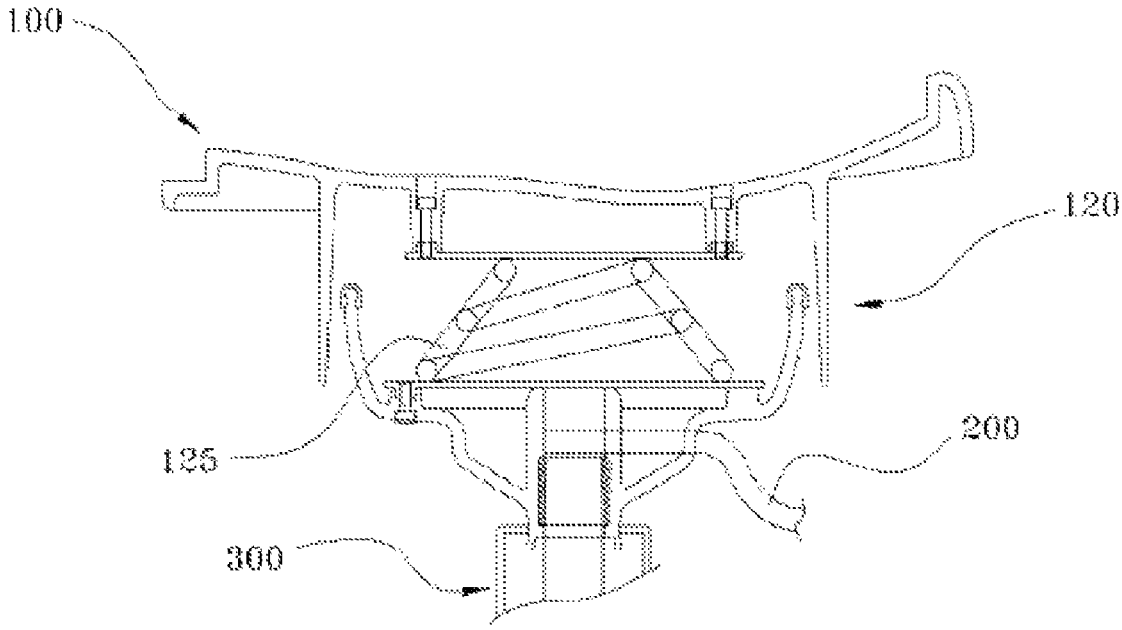
FIG. 3 is a cross sectional view illustrating a chair according to an embodiment of the present invention.
Figure 4:
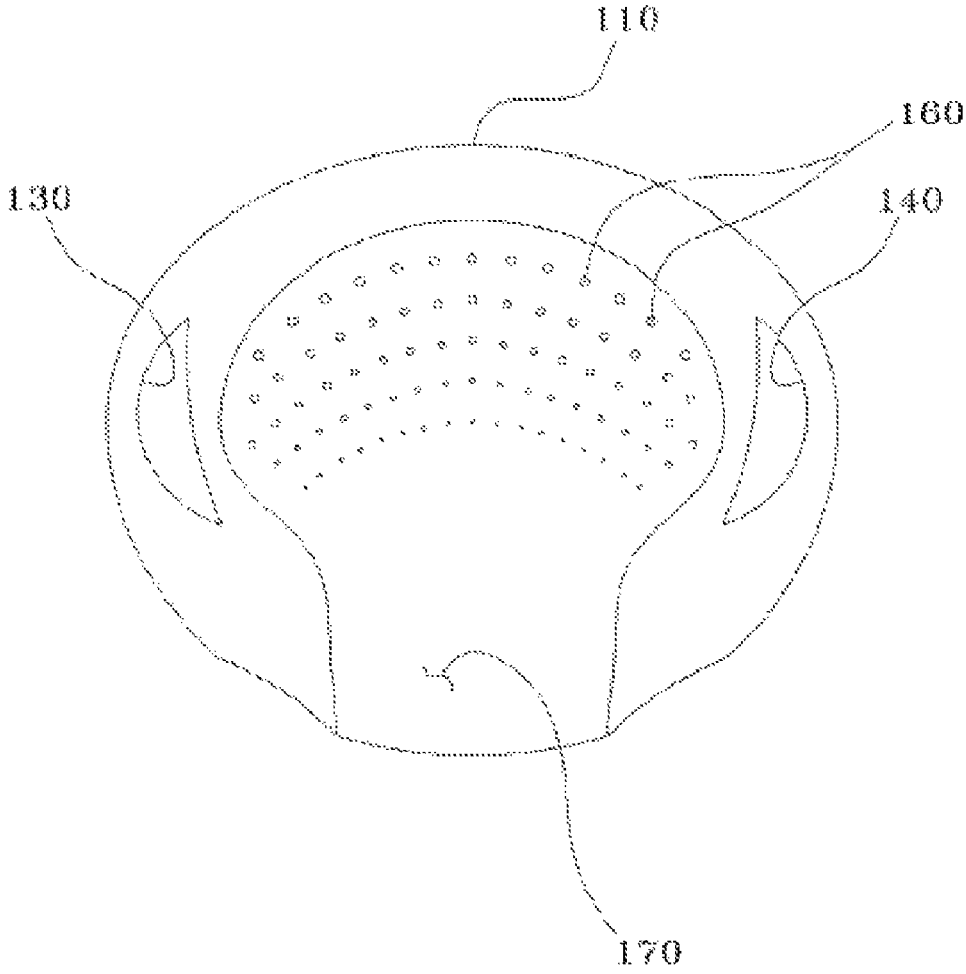
FIG. 4 is a plane view illustrating a seat according to an embodiment of the present invention.
Figure 5:
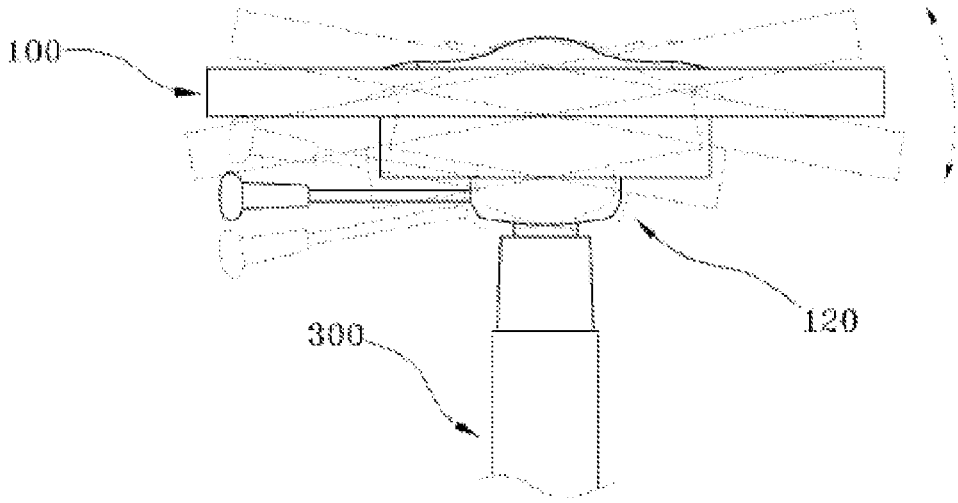
FIG. 5 is a concept view illustrating an operation of a seat according to an embodiment of the present invention.

FIG. 2 is a perspective view illustrating a chair according to an embodiment of the present invention. FIG. 3 is a cross sectional view illustrating a chair according to an embodiment of the present invention. FIG. 4 is a plane view illustrating a seat according to an embodiment of the present invention. FIG. 5 is a concept view illustrating an operation of a seat according to an embodiment of the present invention.

As shown in FIGS. 2 through 4, in the present invention, there is provided a chair for a waist exercise which comprises a seat 100 which has a circular plate 100 for stably supporting a user's hips, and a receptacle 120 which is vertically extended in a downward direction from a lower side of the circular plate 110; a cylindrical connection unit 300 which has an upper end inserted into the receptacle 120 of the lower side of the seat 100 and a certain absorbing force with respect to a pressure when the vertical weight of the seat 100 is applied, with the length of the same being adjustable for thereby adjusting the height of the seat 100; and a support unit 400 which has an upper side engaged at the lower side of the connection unit 300 and is provided with a plurality of legs which are extended in a perpendicular direction.

The circular plate 110 includes handles 130 and 140 are concaved in a certain shape for supporting a user's body as the user holds the same in the course of a waist and pelvic rotation and are installed at both sides, and a plurality of pressurizing portions 160 are provided between the handles 130 and 140 for pressurizing the user's hips when he sits for thereby enhancing a blood circulation, and protrusions 170 are provided on the portions in which the user's scrotum is positioned.

At this time, a user holds the handles 130 and 140 in the course of waist and pelvic rotation exercise while tilting the circular plate 110 for balancing his body. The circular plate 110 is provided instead the common armrest for the reason that the user extends his arms and holds the handles 130 and 140 for thereby exercising without bending a user's backbone, so that it is possible to obtain a right posture and to enhance an exercise effect.

The pressurizing portion 160 formed at the circular plate provides a pressurizing effect for thereby enhancing a blood circulation, and the protrusions 170 are provided for stimulating a user's scrotum portion for thereby enhancing an energetic effect.

At this time, the circular plate 110 is designed to provide a comfort function and is preferably made of a foam urethane material which may be easily integrally formed and molded.

In a preferred embodiment of the present invention, the receptacle 120 and an upper side of the connection unit 300 is preferably connected with a spring 125 which has a certain elastic force.

Here, the spring 125 is formed with its upper side being narrow, with its lower side being wider, so that it is possible to increase a recovery force with respect to a vertical direction weight as well as an inclination of the circular plate 110.

The use of the waist exercise chair according to the present invention will be described in details.

When the chair of the present invention is used as a common chair, the chair can be directly used.

When the chair of the present invention is used for the purpose of exercise, the user's hips and scrotum are positioned on the pressurizing portion 160 and the protrusions 170 of the circular plate 110, and the user holds the handles 130*n* and 140, maintaining an upright posture so that the user stably supports the body.

The pressurizing portion 160 pressurizes the user's hips for thereby circulating the blood, and the protrusions 170 pressurizes the user's scrotum for thereby enhancing a user's energetic function.

In the above state, when the user rotates his waist and belly, the circular plate 110 rotates left and right, so that it is possible to obtain a smooth rotation with the help of returning function to the original position by means of the operation of the spring.

As the user exercises according to the present invention, it is possible to obtain a digestion disorder prevention effect, pelvic correction effect, high joint-related disease prevention effect and menstrual pain prevention effect.

In the case that the waist and pelvic portions are moved forward and backward, the handles 130 and 140 are not held, and the user puts his hands over the head, and the waist and belly are moved at about 15 forward and backward.

So, the circular plate 110 moves forward and backward by the spring 125 installed at the receptacle 120.

The above operation helps a user's postage gland enhancement, energetic strength, waist pain prevention, belly fat prevention, and shoulder pain prevention.

When the waist and belly are moved in left and right directions, the handles 130 and 140 are not held, and the user straights his hands overhead, and the waist and belly are moved left and right at about 15. So, the circular plate 110 moves left and right with the helps of the spring 125 installed at the receptacle 120.

With the above operations, the user may get a slim waist, and the balance of the body may be normalized and become healthy.

The invention claimed is:

1. A chair for a waist exercise, comprising:

a seat which has a circular plate for stably supporting a user's hips, and a receptacle which is vertically extended in a downward direction from a lower side of the circular plate;

a cylindrical connection unit, which has an upper end inserted into the receptacle of the lower side of the seat, absorbs a pressure from a vertical weight on the seat, and a length of the cylindrical connection unit is adjustable so as to adjust the height of the seat;

a support unit which has an upper side engaging a lower side of the connection unit and is provided with a plurality of legs which are extended in a direction perpendicular to an axis of the cylindrical connection unit;

handles provided in the circular plate, wherein the handles include holes through the circular plate having a predetermined shape for supporting a user's body as the user holds the handles for a waist and pelvic rotation and are installed at both sides of the circular plate;

a plurality of pressurizing portions provided on circular plate of the seat between the handles for pressurizing the user's hips when the user sits for thereby enhancing a blood circulation; and a front protrusion provided on the portions of the circular plate in which the user's scrotum is positioned.

2. The chair of claim 1, wherein the receptacle and an upper side of the connection unit are connected with a spring configured to recover the seat to an original direction when an inclining force is removed from the circular plate of the seat, wherein the spring is configured to incline the seat by about fifteen degrees from a horizontal plane and recovers to the original direction.

3. The chair of claim 2, wherein said spring is narrow at an upper side of the spring and gets wider toward a lower side of the spring.

* * * * *